United States Patent [19]

Landuydt

[11] 4,246,912

[45] Jan. 27, 1981

[54] APPARATUS FOR PERFORATING CIGARETTES

[76] Inventor: Louis J. Landuydt, 33 Rue Scoumont, 6249 Obaix, Belgium

[21] Appl. No.: 831,258

[22] Filed: Sep. 7, 1977

Related U.S. Application Data

[63] Continuation-in-part of Ser. No. 817,782, Jul. 20, 1977, and a continuation-in-part of Ser. No. 817,783, Jul. 20, 1977, abandoned.

[30] Foreign Application Priority Data

Sep. 9, 1976 [BE] Belgium ..... 845984

[51] Int. Cl.[2] ..... A24F 47/00; A24F 13/24

[52] U.S. Cl. ..... 131/170 R; 131/254

[58] Field of Search ..... 131/253, 254, 170 R, 131/83, 188, 233, 250, 253

[56] References Cited

U.S. PATENT DOCUMENTS

| | | | |
|---|---|---|---|
| 2,407,931 | 9/1946 | Lindsay et al. | 131/254 |
| 2,854,010 | 9/1958 | Stamm | 131/170 R |
| 4,054,146 | 10/1977 | Ortiz | 131/170 |

*Primary Examiner*—Stephen C. Pellegrino
*Attorney, Agent, or Firm*—Peter E. Heuser

[57] ABSTRACT

Apparatus for perforating cigarettes disposed in rows in a pack comprising first and second relatively movable members defining an opening for receiving one end of a pack of cigarettes. At least the first member carries a plurality of needles for perforating the cigarettes in the pack. The needles face the second member and are positioned to travel in the opening during relative movement of the members towards one another to perforate the cigarettes in the end of the pack disposed in the opening. The needles are aligned in opposition to the second member and thereby are accessible only through the opening.

11 Claims, 10 Drawing Figures

APPARATUS FOR PERFORATING CIGARETTES

CROSS-RELATED APPLICATION

This Application is a continuation-in-part of Ser. Nos. 817,782 and 817,783 filed July 20, 1977, now abandoned.

FIELD OF THE INVENTION

The invention relates to a device for perforating packs of cigarettes or similar smoking materials such as cigars, cigarillos or the like arranged in an ordered manner in the packs in order to perforate the cigarettes. More particularly, the invention relates to a device which partially receives a pack and which includes at least one row of equidistant needles mounted on a common support for penetrating through the pack and the cigarettes therein.

PRIOR ART

In my earlier Belgian Pat. No. 769,991, a device of the above type is disclosed in which the needles project externally from a housing which receives one end of a pack of cigarettes. A slide constituting a casing for receiving the end of the pack of cigarettes is slidably mounted in the housing and when the slide is displaced, the needles are caused to penetrate through the cigarettes in that part of the pack projecting from the casing. As a result, the thrust force applied to the needles acts on a portion of the pack of cigarettes projecting from the casing and there is the danger that the cigarettes will be perforated irregularly and even damaged. Moreover, since the needles are not guided while they are being inserted into the cigarettes in the pack, these needles can deflect from their normal direction up to the point of breakage in use. In addition, since the needles project outside the housing, they constitute a permanent danger for the user who handles the device. Moreover, since the same needles are used to successively perforate the cigarettes in two or more rows, the needles must be relatively long and when taking into account the unsupported nature of the needles this compounds the danger of deflection and breakage hereof. Furthermore, since the needles and the slide are laterally offset, a moment is produced when the slide is displaced which can lead to jamming of the slide and also to distortion of the pack of cigarettes.

An additional disadvantage is that perforation of the cigarettes takes place outside the casing which through mishap can lead to injury of the user particularly when thrust force is being applied to the slide.

SUMMARY OF THE INVENTION

An object of the invention is to provide a cigarette perforating device which overcomes the disadvantages of the known device.

A particular object of the invention is to provide a cigarette perforating device in which the needles or other perforation means are concealed and thereby pose little risk to the user.

A further object of the invention is to provide a cigarette perforating device in which the thrust force for causing the perforation means to perforate the cigarettes is applied in alignment with the perforation means.

In accordance with the invention there is provided apparatus for perforating cigarettes disposed in rows in a pack, said apparatus comprising first and second relatively movable members defining an opening for receiving one end of a pack of cigarettes, perforation means carried by at least one of said members for perforating the cigarettes in said pack, said perforation means on said one member facing the other member and being positioned to travel in said opening during relative movement of said members towards one another to perforate the cigarettes in said one end of said pack in said opening, said perforation means being aligned in opposition to said other member and thereby being accessible only through said opening.

Said perforation means comprises at least one row of equidistantly spaced needles.

According to one embodiment, said other member is formed as a housing for receiving the end of the pack of cigarettes and the housing has openings aligned with the needles for guiding the needles as they penetrate into the pack of cigarettes.

In order to facilitate the return of the needles to their free inital position, the needles are removed from the pack under the action of at least one restoring spring means acting on said one member.

The housing has lateral and rear walls along which slide the lateral and rear walls of the member carrying the needles.

In order to provide maximum safety for the user and protection of the needles in the free, inital position, the tips of the needles are seated in openings provided in a partition wall of the housings, when the needles are retracted. In addition, in order to make it simple and easy to mount the restoring spring for the needles, a strip spring is used, which bears against the bottom of the member with the needles and against the partition wall of the housing.

Members are shaped to provide a casing which has a frontal configuration of the shape of a parallelogram, two sides of which are parallel to the needles. Such a configuration enables the casing to be gripped by one hand of the user and pressure to be applied to cause the needles to pierce the cigarettes in the rows in the pack.

In a further embodiment of the invention, particularly applicable to the arrangement wherein one or two rows of cigarettes are provided in a pack, said first and second relatively movable members respectively comprises jaws movable towards and away from one another, said perforation means comprising needles on at least one of said jaws.

In this further embodiment, the jaws can be flexibly movable towards one another under the application of manual pressure by the user.

According to a feature, the approach of the jaws can be limited by an abutment means fixed to at least one jaw to avoid crushing of the pack of cigarettes at the time of application of pressure. Furthermore, such abutment means can also serve for limiting the degree of insertion of the pack of cigarettes into the opening.

DETAILED DESCRIPTION

The apparatus shown serves for perforating cigarettes 1 arranged in regular manner in a pack 2. The device may also be used for perforating cigars or cigarillos.

In essence, the devices shown in FIGS. 1–4 comprise two members capable of sliding in a rectilinear manner relative to one another. The first member is in the form of a housing 3, in which one end of a pack of cigarettes can be engaged and partially seated. The housing 3 is provided with a frontal opening for insertion of the pack of cigarettes. The second member comprises at least one row of equidistant, parallel metal needles 4 mounted on a common support. During relative sliding of the two members, the needles penetrate through the pack 2 and the cigarettes 1 to perforate the cigarettes. The relative sliding movement between the two members of the device takes place in the direction of the needles 4.

Figure 1:
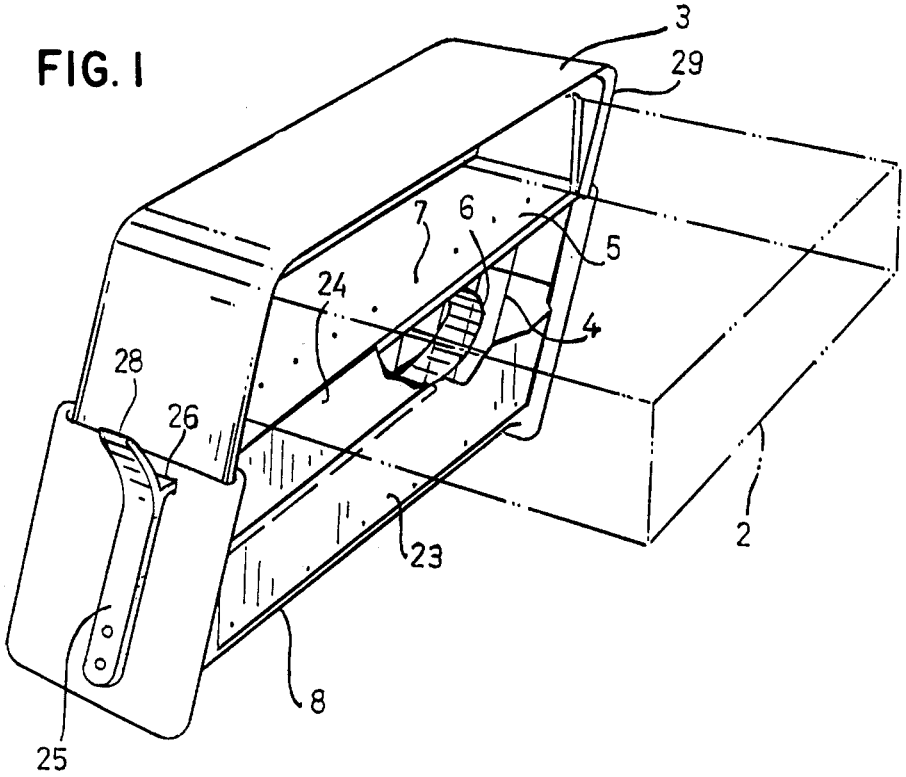
FIG. 1 is a perspective view of a first embodiment of the perforating device according to this invention.
Figure 2:
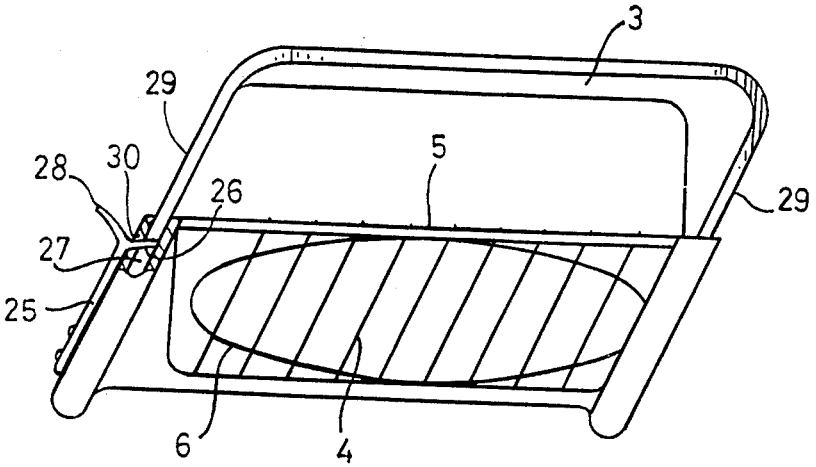
FIG. 2 is a front view of said first device.

In the embodiment of FIGS. 1 and 2 the two members of the device form part of a casing defining two compartments. The first compartment serves as the housing 3 for seating the pack of cigarettes. The second compartment serves for seating the needles 4 in the inactive position. The two compartments are completely open at one common side but may be completely closed on the other sides. The two compartments are separated from each other by a partition 5 extending parallel to the upper and lower walls of the casing.

The first compartment which forms the housing 3 may be considered as the movable one, while the second compartment, possessing grooves 27 at the side to receive lateral walls 29 of the first compartment and comprising the needles 4, may be considered as being fixed. When sliding takes place of the housing 3 relative to the remainder of the casing, the rear wall and lateral walls of this housing 3 are displaced along and against those of the remaining part of the casing. Sliding movement of the housing 3 is produced by application of manual pressure thereon towards the needles 4. The sliding of the housing 3 is carried out in opposition to a restoring spring 6 in the form of a strip, seated in the remaining portion of the casing between the rear wall of the remaining portion and the needles 4. The restoring spring 6 effects return movement of the housing 3 when the manual pressure exerted upon this housing 3 is released.

As can be seen from FIG. 2, the casing has a frontal configuration in the shape of a parallelogram, two sides of which are parallel to the needles 4. When the pack of cigarettes is inserted into the housing 3, its wide surfaces are parallel to the other two sides of the parallelogram. In this manner, during sliding movement of the housing 3, the needles 4 which pass through equally spaced openings 7 in the dividing partition 5 penetrate obliquely through the cigarettes so as to perforate all of them uniformly. According to one inventive concept, in the free retracted position of the housing 3, the free ends of the needles are situated in the openings 7 of the partition 5 and during sliding of the housing 3, the needles 4 are guided by the movable partition 5 so as to be held in equidistant spaced relation while they are thrust into the pack of cigarettes. As a result, in the retracted position the points of the needles are concealed and are not dangerous, while when the device is being used the stems of these needles remain parallel to one another and do not run the risk of being broken.

In the first embodiment, the needles 4 are integral with the lower wall 8 of the housing, this wall forming their common support.

For the purpose of protecting the needles and preventing them from being deformed by application of accidental pressure, two parallel offset plates 23, 24, partially overlapping, have been provided, one of these plates being integral with the lower wall and the other with the partition 5. These plates move toward one another when the casing is compressed and close access to the needles in the second compartment.

A system for locking the compartments when the apparatus is not in use is provided. This system comprises a flexible strip 25 fixed to one side of the casing. The strip carries a lug 26 which engages via a hole 30 a groove 27 formed in the adjacent side of the casing and prevents unintentional relative movement of the compartments. A tongue 28 at the end of the strip enables the lug to be withdrawn from the groove when it is desired to move the compartments towards each other to perforate a pack of cigarettes.

Figure 3:
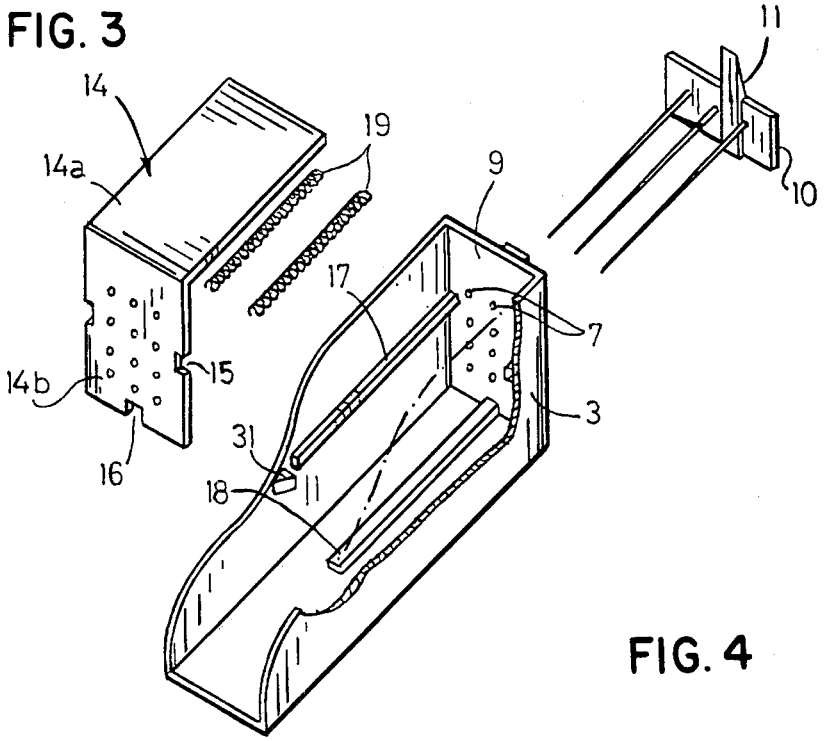
FIG. 3 is an exploded perspective view of a second embodiment of the perforating device according to this invention.
Figure 4:
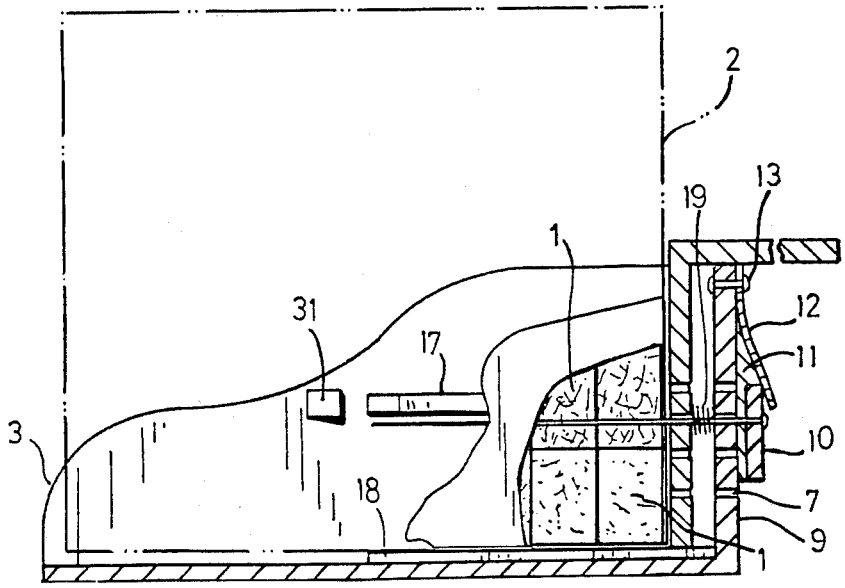
FIG. 4 is a front elevation view partially cut away and in section of the second device.

In the second embodiment, a very much simplified casing 3 is provided especially suitable for perforating cigarettes contained in cardboard boxes. The casing 3 has, on one side wall 9, openings 7 to permit passage of needles 4 which are mounted on a plate 10 constituting a common support therefor. The plate 10 is equipped with a locking strip 11. The assembly comprising needles 4, plate 10 and strip 11 is independent of the casing 3 and can be removed from it for the purpose of adjusting the height of the needles in the holes provided in the wall 9. When the height of the needles is chosen, the strip 11 bears flat against the lateral wall 9 of the casing 3 and is kept clamped thereat by a metal locking strip 12 fixed to the wall 9 by a screw 13. A lid 14 is provided in the casing 3 to cover the needles and seal them. The lid 14 is formed of two plates **14*a* and 14*b* integral with each other and perpendicular to each other as shown in FIG. 3. The vertical plate 14*b* has two lateral opposed notches 15 and a bottom notch 16, into which respectively engage lateral ribs 17 and a bottom rib 18 of the casing 3. In addition, the plate 14*b* has rows of holes 22 corresponding to the holes 7 in the wall 9, so that it can be moved along the needles when the notches 15 of the lid are engaged on the ribs 17**.

In the second embodiment, the lid constitutes a slide which can be moved away from the wall 9 as far as a stop 31 by at least one helical spring 19 bearing at one end against this wall 9 and at the opposite end against the plate **14*b***.

In this second embodiment, the lid is displaceable towards the lateral wall 9 along the ribs 17 in opposition to the force of the spring 19 when the pack of cigarettes placed in the casing 3 is pushed manually against the wall **14*b* of the lid, so that the needles penetrate through the holes 22 into the pack of cigarettes, not obliquely as in FIG. 2**, but perpendicularly to one of the faces of the pack.

After perforation, by releasing the pressure exerted upon the pack of cigarettes, the lid 14 is moved away from the wall 9 by the springs 19 and the pack of cigarettes can be removed from the casing. In this position, the free ends of the needles are maintained in the holes 22 and are not dangerous to the user, while the wall 14*a* prevents access to the needles and protects them against any accidental deformation.

A locking system (not shown) can also be provided to prevent the wall 14*b* of the lid from being unintentionally brought towards the wall 9 of the casing.

As seen in FIGS. 5–10, the apparatus comprises a housing for a pack of cigarettes with two rows of cigarettes having their median planes perpendicular to the parallel planes of the rows. The pack to be perforated can contain only a single row of cigarettes 101 or cigarillos. The housing is formed by two jaws 102,103 which are movable towards one another. They can be molded in two parts of synthetic plastic materials. In the embodiment of FIGS. 5–8 the jaws are flexibly movable towards one another, whereas in the embodiment of FIG. 9 the jaws are movable towards one another against the force of a spring.

Figure 5:
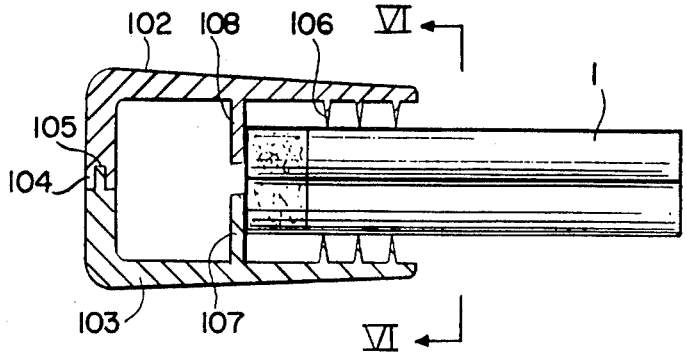
FIG. 5 is an elevation view in section of a third embodiment of the invention illustrating the position before perforation of a pack of cigarettes.
Figure 6:
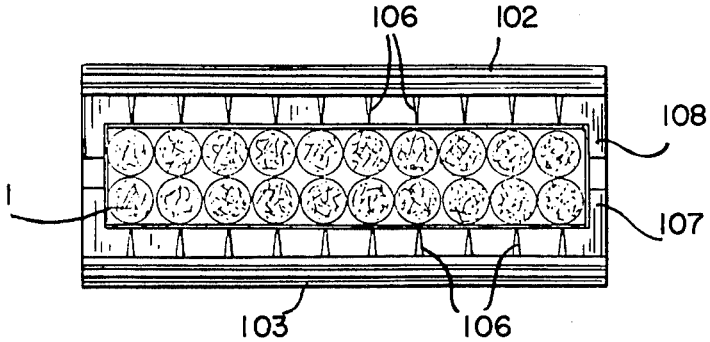
FIG. 6 is a transverse sectional view taken along line VI—VI in FIG. 5.
Figure 7:
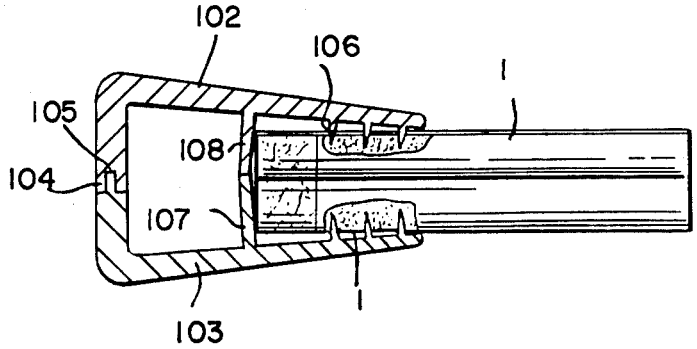
FIG. 7 is a view similar to that of FIG. 1 after perforation of the pack of cigarettes.
Figure 8:
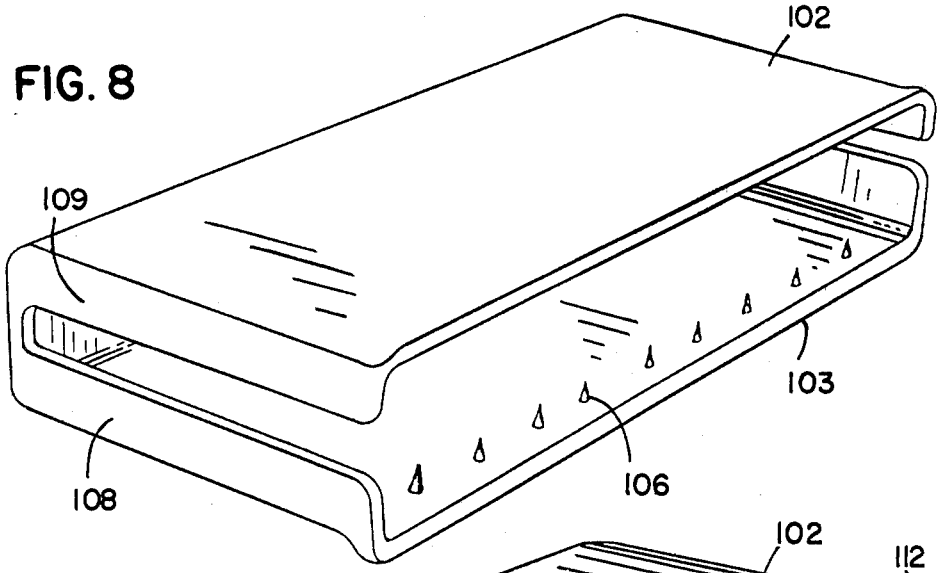
FIG. 8 is a perspective view of a further embodiment of the invention.

In FIGS. 5–7 the jaws are joined together by an adhesive reinforced by a tenon 104 and a mortise 105. In FIG. 8 they are formed as a stamped and shaped one-piece metallic body.

The jaws 102 and 103 are provided with one or a plurality of rows of needles 106 constituting the means for perforation of the pack of cigarettes at the time of approach of the jaws. The needles are equidistantly spaced and preferably extend perpendicular to the longitudinal axis of the cigarettes.

Figure 9:
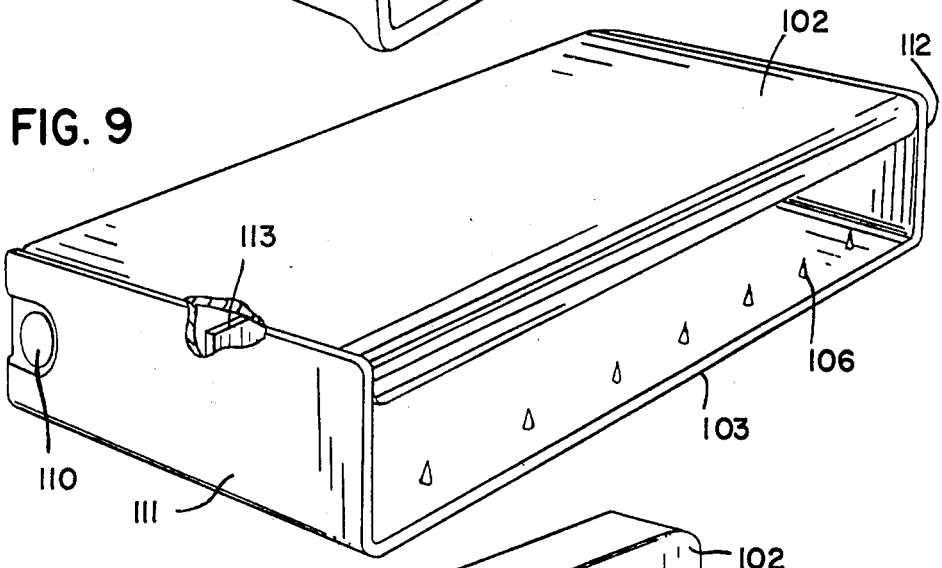
FIG. 9 is a perspective view of another embodiment of the invention.

In a variation, in particular for the perforation of a pack of cigarettes containing only a single row, there is provided needles on one jaw as shown in FIG. 9. The needles on the two jaws can also alternate for every two cigarettes.

Preferably, the needles are provided in a plurality of parallel rows permitting the perforation of the cigarettes with a plurality of holes in a single operation.

The approach of the jaws 102, 103 is limited by abutments 107, 108 secured to at least one of the jaws. These abutments prevent the crushing of the cigarettes after the simple perforation thereof. When the abutments are disposed parallel to the base they also serve as positioning means for limiting the degree of penetration of the pack into the housing as shown in FIGS. 5–7. Advantageously, the abutments are symmetrical permitting the uniform distribution of the pressure of perforation in the two rows of cigarettes.

In the variation illustrated in FIG. 8, the abutments are formed by lateral walls 108,109 projecting from the housing.

In the embodiment of FIG. 9, the jaw 102 constitutes a cover articulated by a rod 110 to the lateral walls 111, 112 of the housing. An abutment 113 limits the descent of the cover in the housing at the time of the application of pressure on the cover to perforate the pack engaged therein. In this embodiment, the pack of cigarettes can be positioned at different locations on the row of teeth in a manner to perforate the cigarettes at a plurality of locations along their lengths.

Figure 10:
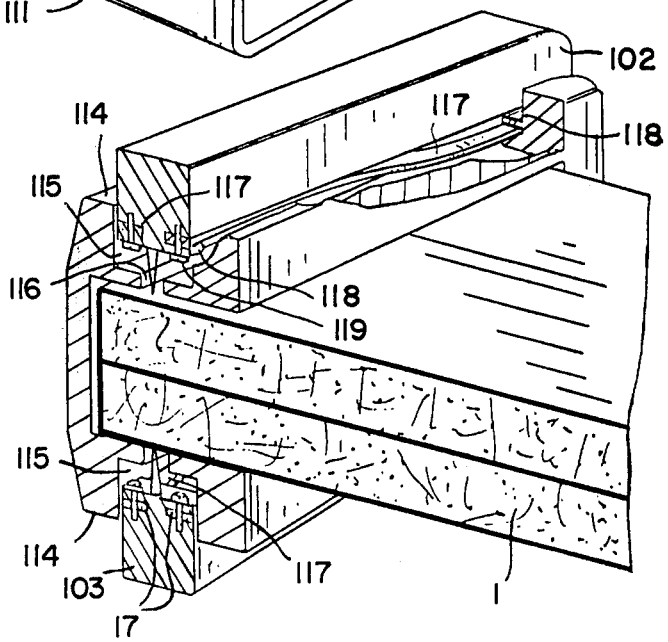
FIG. 10 is a transverse sectional view of yet another embodiment of the invention.

In the embodiment of FIG. 10, two opposed exterior walls 114 extend perpendicular to the parallel planes of the rows of cigarettes. The walls 114 are provided with grooves 115 having, at the bottom, a narrow opening 116 for the passage of the needles. The jaws 102, 103 are guided in the grooves when the needles 106 are engaged in the openings 116 to perforate the pack of cigarettes engaged in the housing. The grooves 115 receive blade springs 117 which bear on the bottom of the jaws and against the narrow opening and urge the jaws 115 to the released, inoperative position when the manual pressure is released, such that in this position of rest the points are retracted from the interior of the housing. The springs also serve to hold the jaws in the grooves. In this regard the bottom of the grooves and the jaws are provided with hooks 118 molded therewith permitting, by means of screws 119, the attachment of the springs.

In a variation which is not shown, the bottom of the housing is open permitting displacement of the pack through the jaws and the perforation of the cigarettes at a plurality of locations along their lengths.

As is evident from the above, the apparatus provides for first and second relatively movable members which define an opening for receiving one end of the pack of cigarettes and perforation means in the form of needles carried by at least one of the members perforating the cigarettes in the pack. The preforation means on said one member faces the other member and is positioned to travel in the opening during relative movement of the members towards one another to perforate the cigarettes in said one end of said pack in said opening. The needles are aligned in opposition to said other member and thereby are accessible only through said opening. As a consequence, the line of action of the thrust force applied by the user is aligned with the needles, while the needles themselves do not freely project beyond the opening in which the pack of cigarettes is inserted thereby minimizing the risk of injury to the user.

Although the invention has been described in conjunction with various embodiments, it is obvious to one skilled in the art that numerous modifications and variations can be made without departing from the scope and spirit of the invention as defined in the attached claims.

What is claimed is:

1. Apparatus for perforating cigarettes disposed in at least one row in a pack, said apparatus comprising:

two relatively movable members defining an opening for receiving an end of a pack of cigarettes, said members each having a lateral wall on each side of said opening, the lateral walls of each member being slidably engaged by the lateral walls of the other member;

perforation means mounted to at least one of said members for perforating cigarettes in the pack, said perforation means on said one member facing and in alignment with the other member and being positioned to travel in said opening during relative movement of said members towards one another, thereby perforating cigarettes positioned in said opening.

2. Apparatus as claimed in claim 1 wherein said perforation means comprises at least one row of equidistantly spaced needles.

3. Apparatus as claimed in claim 2 further comprising a partition having openings aligned with said needles for guiding said needles as said needles pass into said opening during initial relative movement of said members towards one another.

4. Apparatus as claimed in claim 3 comprising spring means for urging said members apart to extract said needles from the cigarettes after perforation.

5. Apparatus as claimed in claim 2 wherein said one member has a base on which said needles are mounted in common.

6. Apparatus as claimed in claim 5 wherein said spring means comprises a spring acting between said base and said partition.

7. Apparatus as claimed in claim 5 wherein said apparatus has a frontal configuration in the shape of a parallelogram, with said lateral walls of said members being parallel to said needles.

8. Apparatus as claimed in claim 1 wherein said members are movable between an extended position in which said needles are extended into said opening for perforating the cigarettes and a retracted position in which said needles are retracted from said opening.

9. Apparatus as claimed in claim 1 wherein the other said members further comprises a rear wall for limiting the degree of insertion of cigarettes into said opening.

10. Apparatus as claimed in claim 9 wherein said needles have points seated in said openings in said partition when said members are in the retracted position.

11. Apparatus for perforating cigarettes disposed in rows in a pack, said apparatus comprising:

first and second relatively movable members defining a opening for receiving one end of a pack of cigarettes, said members each including lateral and rear walls slidably engaged with the lateral and rear walls of the other;

at least one row of equidistantly spaced needles mounted to at least one of said members for perforating the cigarettes in a pack;

a partition having openings aligned with said needles for guiding said needles as said needles pass into said opening during initial relative movement of said members towards one another; and spring means for urging said members apart to extract said needles from the cigarettes after perforation.

* * * * *